United States Patent [19]

Iwata et al.

[11] 4,169,352

[45] Oct. 2, 1979

[54] EXHAUST GAS CLEANING APPARATUS OF AN INTERNAL COMBUSTION ENGINE

[75] Inventors: Minoru Iwata, Susono; Takeru Yasuda, Nagoya; Hidenori Hirosawa, Obu, all of Japan

[73] Assignees: Toyota Jidosha Kogyo Kabushiki Kaisha, Toyota; Aisaon Industry Co., Ltd., Obu, both of Japan

[21] Appl. No.: 840,097

[22] Filed: Oct. 6, 1977

[30] Foreign Application Priority Data

Jun. 29, 1977 [JP] Japan ..... 52-076567

[51] Int. Cl.[2] ..... F01N 3/10

[52] U.S. Cl. ..... 60/276; 60/290; 60/294

[58] Field of Search ..... 60/276, 290, 294, 289

[56] References Cited

U.S. PATENT DOCUMENTS

| | | | |
|---|---|---|---|
| 3,962,867 | 6/1976 | Ikeura | 60/290 |
| 4,037,406 | 7/1977 | Hartel | 60/276 |
| 4,087,964 | 5/1978 | Miyagi | 60/293 |
| 4,112,676 | 9/1978 | Miyagi | 60/276 |

*Primary Examiner*—Douglas Hart

*Attorney, Agent, or Firm*—Stevens, Davis, Miller & Mosher

[57] ABSTRACT

Disclosed are an exhaust gas cleaning apparatus of an internal combustion engine, which is provided with a three-way catalytic converter, and an air injection system responsive to the air-fuel ratio of the exhaust gas in the exhaust pipe for increasing or decreasing the amount of secondary air directed to the exhaust pipe so that the air-fuel ratio in the converter is maintained near the stoichiometric value. Means are provided for obtaining a high rate of increase in the introduction of secondary air when the acceleration pump is operated for introducing an amount of excess fuel into the engine during acceleration of the engine. Thus, the air fuel ratio occurring during this condition can be effectively controlled near the stoichiometric value.

5 Claims, 4 Drawing Figures

-mmHg
P1
P2
P0
P0'
t1
t2
q
p
A
10
12
14
16
18
20
22
24
26
28
30
32
34
36
38
40
41
42
44
46
48
50
52
54
56
58
60
62
64
66
68
70
72
74
76
78
78a
80
80a
82
84
86
86a
86b
86c
88
90
100
102
104
106
108
110
112
114
116
116a
119
120
122
124
126
130
130a
130b
132
134

EXHAUST GAS CLEANING APPARATUS OF AN INTERNAL COMBUSTION ENGINE

FIELD OF THE INVENTION

The present invention relates to an exhaust gas cleaning apparatus for an internal combustion engine, which apparatus includes a three-way catalytic converter arranged in the exhaust system of the engine.

BACKGROUND OF THE INVENTION

Already known in the prior art is a three-way catalytic converter which can clean three major toxic components (HC, CO and $NO_X$) in the exhaust gas. The operation of the three-way catalytic converter is effectively attained when the exhaust gas is in a state wherein excess air as well as excess fuel is not left in the exhaust gas, i.e., the air-fuel ratio of the exhaust gas (the ratio of air remaining in the exhaust gas to fuel remaining in the exhaust gas) is maintained near the stoichiometric value.

For maintaining the air-fuel ratio near the stoichiometric value, an air injection system has been provided in the prior art for controlling the amount of secondary air introduced into the exhaust manifold in accordance with electrical signals transmitted from an oxygen-concentration-cell type air-fuel sensor, for example, an $O_2$ sensor which is arranged in an exhaust pipe of the engine. This air injection system has a vacuum-operated flow control valve including a spring-urged diaphragm which forms a vacuum chamber on one side thereof. To this chamber, a vacuum signal is selectively introduced from the intake manifold of the engine in accordance with the electrical signal transmitted from the $O_2$ sensor. The amount of secondary air directed to the exhaust system is thus selectively increased for maintaining the air-fuel ratio of the exhaust gas directed to the catalytic converter near the stoichiometric value.

In the known air-injection system a relatively slow rate of increase in the amount of secondary air is maintained for effectively controlling the air-fuel ratio to the stoichiometric value during the constant rotational operation of the engine. However, this known system suffers from the drawback wherein the air-fuel ratio of the exhaust gas is not effectively controlled near the stoichiometric value when the engine begins to accelerate. The reason for this disadvantage is due to the operation of the acceleration pump during the time when the engine begins to accelerate for introducing an excess amount of fuel into the engine in order to produce a stabilized accelerating condition. The excess amount of fuel causes the air-fuel ratio in the exhaust pipe to reach a lean value which in turn prevents the catalytic converter from cleaning the $NO_X$ components remaining in the exhaust gas.

SUMMARY OF THE INVENTION

An object of the present invention is to provide an exhaust gas cleaning apparatus which comprises a three-way catalytic converter and an air-injection system, which apparatus is capable of effectively eliminating the three major toxic components even if the engine is operating under an acceleration condition.

Another object of the present invention is to provide an exhaust gas cleaning apparatus of the above-mentioned type which can increase the rate of increase in the amount of secondary air directed to the exhaust pipe when the engine begins to accelerate.

According to the present invention, an exhaust gas cleaning apparatus of an internal combustion engine with an intake system, an engine body and an exhaust system comprises:

a catalytic converter disposed in the exhaust system, which converter effectively operates to clean the exhaust gas when the air-fuel ratio of the exhaust gas directed to the catalytic converter is maintained near a predetermined value;

pipe means connected to the exhaust system at a position located upstream of the calalytic converter for introducing secondary air into the exhaust system;

flow-control valve means located on the pipe means having a pressure signal chamber for controlling the amount of secondary air directed to the exhaust system in response to the pressure level in the chamber;

sensor means arranged in the exhaust system for providing electric signals which indicate the air-fuel ratio of the exhaust gas;

pressure signal conduit means for connecting the pressure signal chamber of the flow-control valve with a pressure signal source;

pressure switching valve means responsive to the electric signals transmitted from the sensor means for selectively introducing a pressure signal from the source into the pressure signal chamber of the flow control valve means via the pressure signal conduit means in order to selectively increase the amount of secondary air directed into the exhaust system via the pipe means;

first orifice means disposed in the pressure signal conduit means at a position located upstream of the pressure switching valve means for controlling the rate of increase in the amount of secondary air, and;

pressure control means for maintaining, when the engine is operating under an acceleration condition, a rate of increase in the amount of secondary air high enough to effectively control the air-fuel ratio near to the predetermined value during the engine acceleration condition.

DESCRIPTION OF THE PREFERRED EMBODIMENTS

Figures 1, 2:
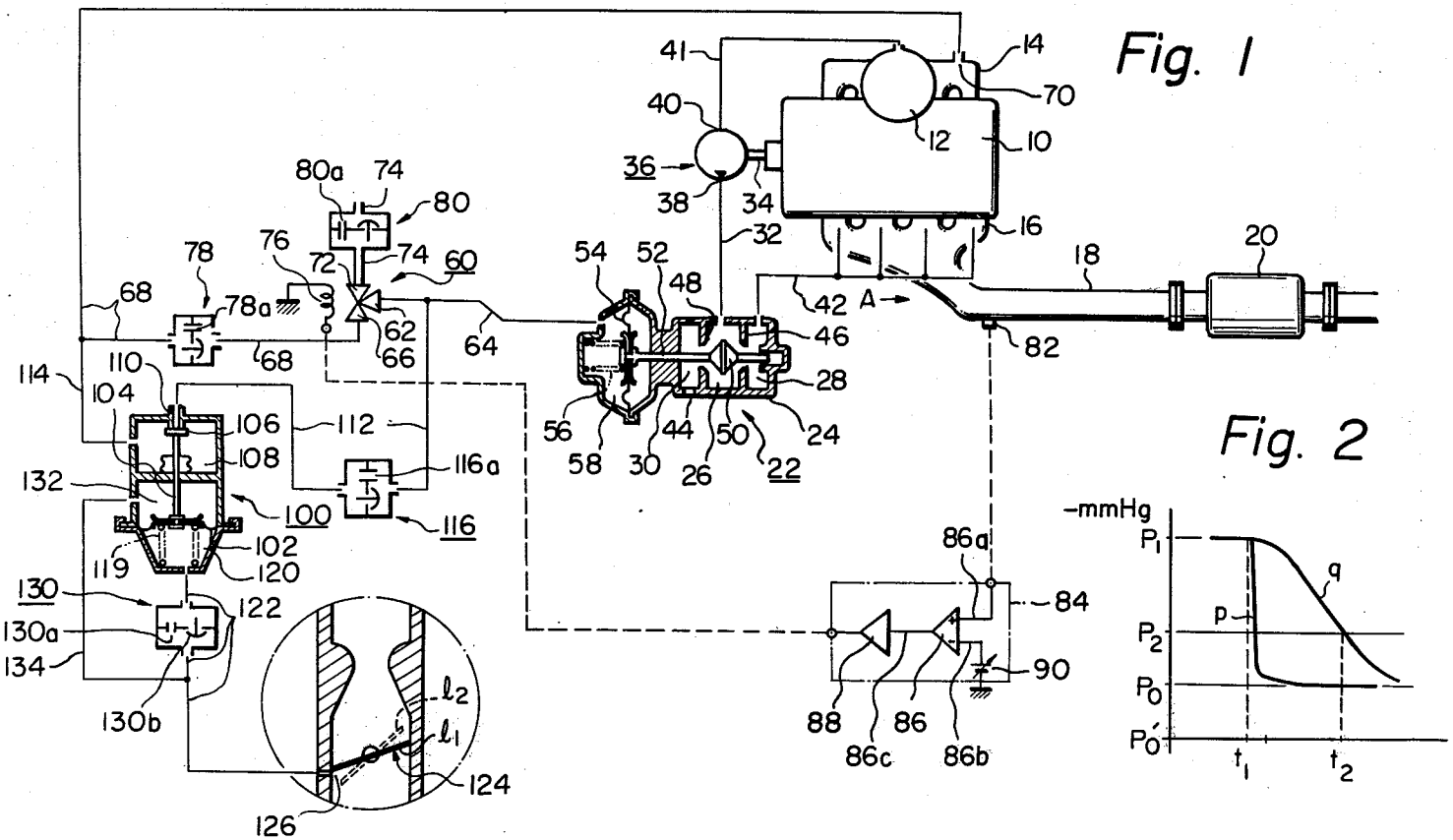
FIG. 1 is a schematic view of an exhaust gas cleaning apparatus according to the present invention.
FIG. 2 shows graphs showing the relationships between the lapse of time from the starting of the acceleration and the vacuum level in the chambers (120 and 132) of the control valve 100; and, FIGS. 3 and 4 show a second embodiment and a third embodiment of the present invention, respectively.

In FIG. 1 schematically illustrating a first embodiment of an internal combustion engine according to the present invention, the numeral 10 designate an engine body. Intake air is introduced into the combustion chambers (not shown) in the engine body 10, via an air cleaner 12, a not-shown carburetor and an intake manifold 14. Resultant exhaust gas, due to the combustion in each of the combustion chambers, is introduced into an exhaust manifold 16, to which an exhaust pipe 18 is connected. A three-way catalytic converter 20 is located downstream from the exhaust pipe 18. The three-way catalytic converter 20 effectively operates to clean the three major toxic components in the exhaust gas, when the air-fuel ratio directed to the converter 20 is kept near the stoichiometric value.

Numeral 22 designates a vacuum-operated valve for controlling the amount of secondary air introduced into the exhaust manifold 16 in response to the vacuum pressure applied to the valve 22. The valve 22 has a body 24 which forms three air chambers 26, 28 and 30. The air chamber 26 is connected, via an air pipe 32, to an air pump 36 at an outlet 38 thereof. The pump 36 is driven by a crankshaft 34 of the engine body 10. An inlet 40 of the air pump 36 is connected via an air pipe 41 to a purified space in the air cleaner 12. Thus, an amount of secondary air from the air cleaner 12 can be introduced into the air chamber 26 by the rotation of the crankshaft 34. The air chamber 28 is connected to each branch pipe of the exhaust manifold 16 by an air injection pipe 42 for introducing the secondary air into the exhaust manifold 16. The air chamber 30 is opened to the atmosphere through a port 44 for discharging an excess amount of air therefrom. A first valve seat 46 is formed between the air chamber 26 and the air chamber 28. A second valve seat 48 is formed between the air chamber 26 and the air chamber 30. A valve member 50, for controlling the amount of air directed to the chamber 28 from the chamber 26, is situated between the first valve seat 46 and the second valve seat 48. The valve member 50 is connected via a rod 52 to a diaphragm 54 which is urged by a spring 56. Thus, the position of the valve member 50 with respect to the valve seat 46 or 48 is controlled by a vacuum force generated on the diaphragm 54.

In order to generate a vacuum force on the diaphragm 54, a vacuum signal chamber 58 is formed on one side of the diaphragm 54, which chamber 58 is connectable to a vacuum signal port 70 in the intake manifold 14 by means of a pipe system which will be fully described later.

Numeral 60 designates a vacuum switching valve of an electromagnetic type for selectively connecting the chamber 58 of the flow control valve to the vacuum signal port 70 or to the atmosphere, in order to control the vacuum force on the diaphragm 54 for controlling the amount of secondary air directed to the air injection pipe 42 as shown by an arrow A in FIG. 1. The switching valve 60 has a common port 62, a first switching port 66 and a second switching port 72. The common port 62 is connected to the vacuum signal chamber 58 via a vacuum conduit 64. The first switching port 66 is connected to the vacuum signal port 70 via a vacuum signal intake conduit 68. In this conduit 68, a vacuum transmitting valve 78 having an orifice 78*a* is provided. The orifice 78*a* is adapted to control the speed of introducing a vacuum signal transmitted from the port 70 to the first switching port 66. The second switching port 72 is opened to the atmosphere via an atmospheric air intake conduit 74. In the conduit 74, another vacuum transmitting valve 80 having an orifice 80*a* is provided. The orifice 80*a* is adapted to control the speed of introducing the atmospheric air pressure signal from the atmosphere to the second switching port 72. The electromagnetic switching valve 60 has a solenoid 76 for operating the switching valve 60.

When the solenoid coil 76 is energized, the valve 60 is in its first position via which the common port 62 communicates with the first switching port 66. In this first position, a vacuum signal at the vacuum signal port 70 can be introduced into the vacuum signal chaber 58 of the vacuum-operated valve 22, in order to gradually increase the vacuum force applied to the diaphragm 54. This increase in the vacuum force causes the valve member 50 to be moved away from the valve seat 46, so that the amount of air directed to the air injection pipe 42, as shown by the arrow A, is increased. Because of the increase in the amount of the secondary air directed to the air-injection pipe 42, the air-fuel ratio of the exhaust gas in the exhaust pipe 18 connected to the pipe 42 becomes lean (or increased). The rate of increase in the air-fuel ratio corresponds to the rate of movement of the valve body, in other words, to the rate of increase in the vacuum force generated on the diaphragm 54.

When the solenoid coil 76 is de-energized, the switching valve 60 is in its second position via which the common port 62 communicates with the second switching port 72. In this position, atmospheric air is introduced into the signal chamber 58 of the flow control valve 22, in order to gradually decrease the vacuum force applied to the diaphragm 54. This decrease in the vacuum force causes the valve member 50 to be moved toward the valve seat 46, so that an amount of air directed to the air injection pipe 42, as shown by the arrow A, is decreased. As a result of this decrease in the amount of secondary air directed to the exhaust pipe 18 via the air-injection pipe 42, the air-fuel ratio of the exhaust gas in the exhaust pipe 18 becomes "rich" (or decreased).

Numeral 82 is an oxygen-concentration-cell type sensor, for example, an $O_2$ sensor, which is disposed in the exhaust pipe for providing electric signals indicating the air-fuel ratio of the exhaust gas directed to the three-way catalytic converter 20. As is well known to those skilled in this field, the $O_2$ sensor provides a high-voltage electric signal when the air-fuel ratio of the exhaust gas is rich, and a low-voltage electric signal when the air-fuel ratio is lean.

Numeral 84 is a control device having a comparator unit 86 electrically connected to the $O_2$ sensor 82 at an input 86*a* of the unit. The control device 84 further has an amplifier unit 88 which is on one end thereof connected to an output 86*c* of the unit 86 and is on the other end thereof connected to the solenoid coil 76 of the vacuum switching valve 60. The voltage level at another input 86*b* of the comparator unit 86 is lower than the high level signal from the $O_2$ sensor 82 and higher than the low level signal from the $O_2$ sensor 82. Therefore, an output pulse signal is provided at the output 86*c* when a high level signal, which indicates a rich air-fuel ratio of the exhaust gas in the exhaust pipe 18, is received by the input 86*a*. This output pulse signal is transmitted, via the amplifier unit 88, to the solenoid coil 76 for energizing the coil 76. Thus, the vacuum transmitting valve 60 is switched to its first position via which the common port 62 communicates with the first switching port 66.

When a low-level signal from the $O_2$ sensor 82, which signal indicates a lean air-fuel ratio of the exhaust gas, is received by the input 86*a* of the comparator unit 86, no output pulse signal is generated at the output 86*c*. Thus, the solenoid coil 76 is de-energized, causing the vacuum switching valve 60 to be switched to its second position via which the common port 62 communicates with the second switching port 72.

As is described hereinabove, when the air-fuel ratio of the exhaust gas directed to the three-way catalytic converter 20 is rich, the vacuum switching valve 60 is in its first position via which the common port 62 communicates with the port 66. As a result of this, the vacuum force generated on the diaphragm 54 of the flow control valve 22 is gradually increased because the orifice 78*a* in the conduit 68 is present. Thereby the valve member 50 is moved away from the valve seat 46. Accordingly, the amount of secondary air directed to the air-injection pipe 42, as shown by the arrow A, is increased. The air-fuel ratio in turn is increased to the stoichiometric value, thereby causing the three-way catalytic converter 20 to operate effectively. When the air-fuel ratio of the exhaust gas is lean, the vacuum switching valve 60 is in its second position via which the port 62 communicates with the second switching port 72. As a result of this, a vacuum force of the diaphragm 54 is gradually decreased because of the presence of the orifice 80*a*. The valve member 50 is thus moved toward the valve seat 46. Accordingly, the amount of secondary air directed to the air injection pipe 42, as shown by the arrow A, is decreased. In addition, the air-fuel ratio is decreased to the stoichiometric value in order to effectively operate the three-way catalytic converter 20.

In the above-mentioned apparatus, the dimension of the orifice 78*a* is so determined that a suitable rate of increase in the amount of the secondary air directed to the air injection pipe 42 as shown by the arrow A is obtained when the engine is operating under a constant rotational speed. However, the rate of increase in the amount of secondary air determined by the orifice 78*a* is not sufficient enough to effectively keep the stoichiometric value of air-fuel ratio when the engine is under the accelerating condition. This is because, the acceleration pump of the engine operates to supply an excess amount of fuel into the intake manifold 14 when the engine begins to accelerate for carrying out a proper acceleration operation. Therefore, means are necessary for increasing the rate of increase in the amount of secondary air, which rate corresponds to the rate of introducing a vacuum signal from the vacuum port 70 to the vacuum signal chamber 58 in the embodiment of FIG. 1.

According to the present invention, a vacuum transmitting valve 116 is disposed on a vacuum by-pass conduit 112 which is connected on one end to the vacuum conduit 64. The vacuum transmitting valve 116 has a orifice 116*a* having a inner dimension which is larger than that of the orifice 78*a*.

A vacuum-operated valve 100 operates to direct the vacuum signal to the large orifice 116*a* when the engine begins to accelerate. The valve 100 has a valve member 106 which can be seated on or detached from a valve seat 110 for controlling the connection between the vacuum by-pass, conduit 112 and a chamber 108 which is connected via a vacuum conduit 114 to the vacuum conduit 68. The valve member 106 is connected via a rod 104 to a diaphragm 102 which forms a first chamber 132 on the upper side thereof. On the lower side of the diaphragm 102, which is urged upwardly by a spring 119, a second chamber 120 is formed. On a vacuum conduit 122, which connects the second chamber 120 with a vacuum signal port 126, a vacuum transmitting valve 130 comprised of an orifice 130*a* and a check valve 130*b* is disposed. The vacuum signal port 126 is formed in a carburetor at a position slightly below a throttle valve 124 when the throttle valve 124 is in its idle position. The first chamber 132 is connected to the vacuum conduit 122 by a vacuum conduit 134.

In the operation of the above-mentioned apparatus, when the throttle valve 124 is in its idle position as shown by a solid line $l_1$ in FIG. 1, the vacuum signal port 126 is located downstream of the throttle valve 124. The first chamber 132 is under a vacuum pressure $P_1$ (FIG. 2) which is substantially the same as the pressure level of the port 126, since the port 126 is opened to the chamber 132 via the conduits 122 and 134. The second chamber 120 is also under the same vacuum level $P_1$ (FIG. 2) as that of the port 126, since the check valve 130*b* operates to transmit the vacuum signal freely therethrough. Thus, there is no difference between the pressure of the first chamber 132 and the pressure of the second chamber 120, and the diaphragm 102 is thereby moved upwardly by the spring 119 so that the valve member 106 is rested on the valve seat 110. Accordingly, the vacuum conduit 114 is prevented from being connected with the vacuum conduit 112. Thus, the vacuum signal from the port 14 is not directed to the orifice 116*a* with the large dimension.

When the throttle valve is moved from the idle position $l_1$ at a time $t_1$ (FIG. 2) in order to start the acceleration, the throttle valve 124 is located upstream of the vacuum port 126 as shown by a dotted line $l_2$ (FIG. 1). Due to this condition, the pressure of the first chamber 108 instantly reaches the level of the pressure $P_0$ near the atmospheric air pressure $P_0'$, as shown by a line p of FIG. 2, since the port 126 is opened to the first chamber 132 via the vacuum conduits 134 and 122. Whereas, the vacuum level of the second chamber 120 is gradually decreased as shown by a line q (FIG. 2) since the orifice 130*a* is located between the second chamber 120 and the vacuum signal port 126. Consequently, due to a large pressure difference $P_1-P_0$ occurring between the chambers 120 and 132, the diaphragm 102 is displaced downwardly against the force of the spring 119. Accordingly, the valve member 106 of the control valve 100 is detached from the valve seat 110, thereby causing the chamber 108 to be connected to the vacuum conduit 112. Therefore, the rate of introducing the vacuum signal from the port 70 of the intake manifold 14 into the vacuum signal chamber 58 of the flow control valve (which rate corresponds to the rate of movement of the valve member 50 away from the valve seat 46) is determined by the large orifice 116*a*. As a result, a high rate of increase of the secondary air, which is directed to the exhaust manifold 16 when the engine begins to accelerate at the time $t_1$, (FIG. 2) is attained. Therefore, the air-fuel ratio of the exhaust gas is effectively maintained near the stoichiometric value, even if an excess amount of fuel is introduced into the engine 10 by the acceleration pump when the engine begins to accelerated.

At the time $t_2$ after sufficient time has elapsed (in other words, when the engine is under a constant rotational speed operation), the vacuum level of the second chamber 120 reaches the value $P_2$. The pressure difference $P_2-P_0$ between the chambers 132 and 120 is not large enough to displace the diaphragm 102 against the spring 119. Therefore, the diaphragm 102 is moved upwardly by the spring 119, so that the valve member 106 is rested on the valve seat 110, thereby causing the chamber 108 to be disconnected from the vacuum conduit 112. Due to this disconnection, the rate of introducing a vacuum signal into the chamber 58 of the flow control valve 22 is determined by the small orifice 78*a*. As a result, a low rate of increase in the amount of secondary air is attained during when the engine is under a constant rotational speed operation. This low rate of increase causes the air-fuel ratio to be maintained near the stoichiometric value, since the introduction of an excess amount of fuel into the engine by the acceleration pump is now stopped at the time $t_2$.

Figure 3:
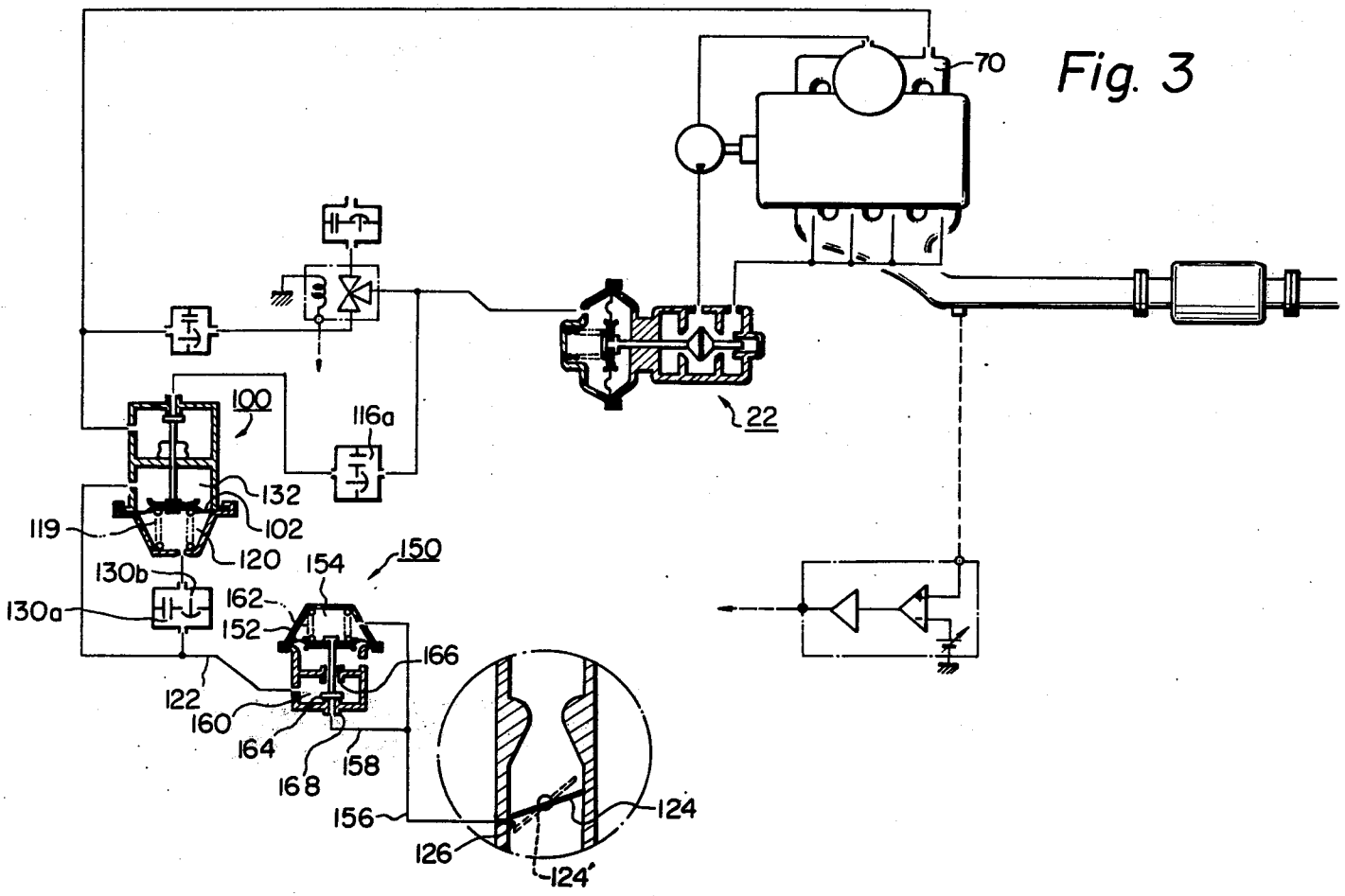

A second embodiment of the present invention as shown in FIG. 3 differs from the first embodiment of FIG. 1 in that the introduction of the vacuum signal at the vacuum signal port 126 into the control valve 100 is controlled by an acceleration sensor valve 150. The valve 150 has a diaphragm 152 forming a vacuum chamber 154 on one side thereof, which chamber 154 is connected to the vacuum signal port 126 by a vacuum conduit 156. The diaphragm 152 urged downwardly by a spring 162 is connected to a valve member 164 which is located between a valve seat 166 and a valve seat 168, and operates to selectively connect a chamber 160 with a vacuum conduit 158 connected to the conduit 156. The vacuum conduit 122 is also connected to the chamber 160.

In the operation of the second embodiment shown in FIG. 3, when the throttle valve 126 is in its idle operation, the vacuum chamber 154 is under the effect of a vacuum pressure which causes the valve member 164 to be seated on the valve seat 166. The vacuum affecting the second chamber 120 is the same as the vacuum of the first chamber 132, since the check valve **130*b* of the vacuum transmitting valve 130 permits the vacuum signal to freely pass from the vacuum signal port 126 to the second chamber 120**.

As the engine begins to accelerate, the throttle valve 124 is moved as shown by the dotted line 124' in FIG. 3. Accordingly, the pressure of the chamber 154 opened to the port 126 approaches near atmospheric pressure, thereby the spring 162 moves the diaphragm 152 downwardly, which in turn causes the valve seat 168 to be rested by the valve member 164. The pressure level of the first chambers 132 can therefore instantly reach the level of atmospheric pressure $P_0'$ (FIG. 2) since the chamber 160 is communicating with the valve seat 166 which is opened to the atmosphere. Thus, the pressure of the second chamber 120 is gradually increased to the level of atmospheric pressure $P_0'$.

As has already been described above with respect to the embodiment of FIG. 1, because the control valve 100 operates to direct the vacuum signal from the port 70 to the large orifice **116*a* when the engine is stopped, the pressure difference between the chambers 120 and 130 becomes small enough for the spring 119 to displace the diaphragm 102 upwardly. Accordingly, the control valve 100 can be operated to prevent a vacuum signal from being introduced into the large orifice 116*a***.

In the embodiment shown in FIG. 3, the valve 150 is used to detect the acceleration condition. The pressure level in each of the chambers 120 and 132 can reach an atmospheric pressure $P_0'$ lower than $P_0$ (FIG. 2). Therefore, the maximum pressure difference between the chambers 132 and 120 approaches $P_1-P_0$, which difference is larger than the maximum pressure difference $P_1-P_0$ in the embodiment of FIG. 1. As a result, the period from the time $t_1$, corresponding to the opening of the valve 100, to the time $t_2$, corresponding to the closing of the valve 100, can be effectively adjusted.

Figure 4:
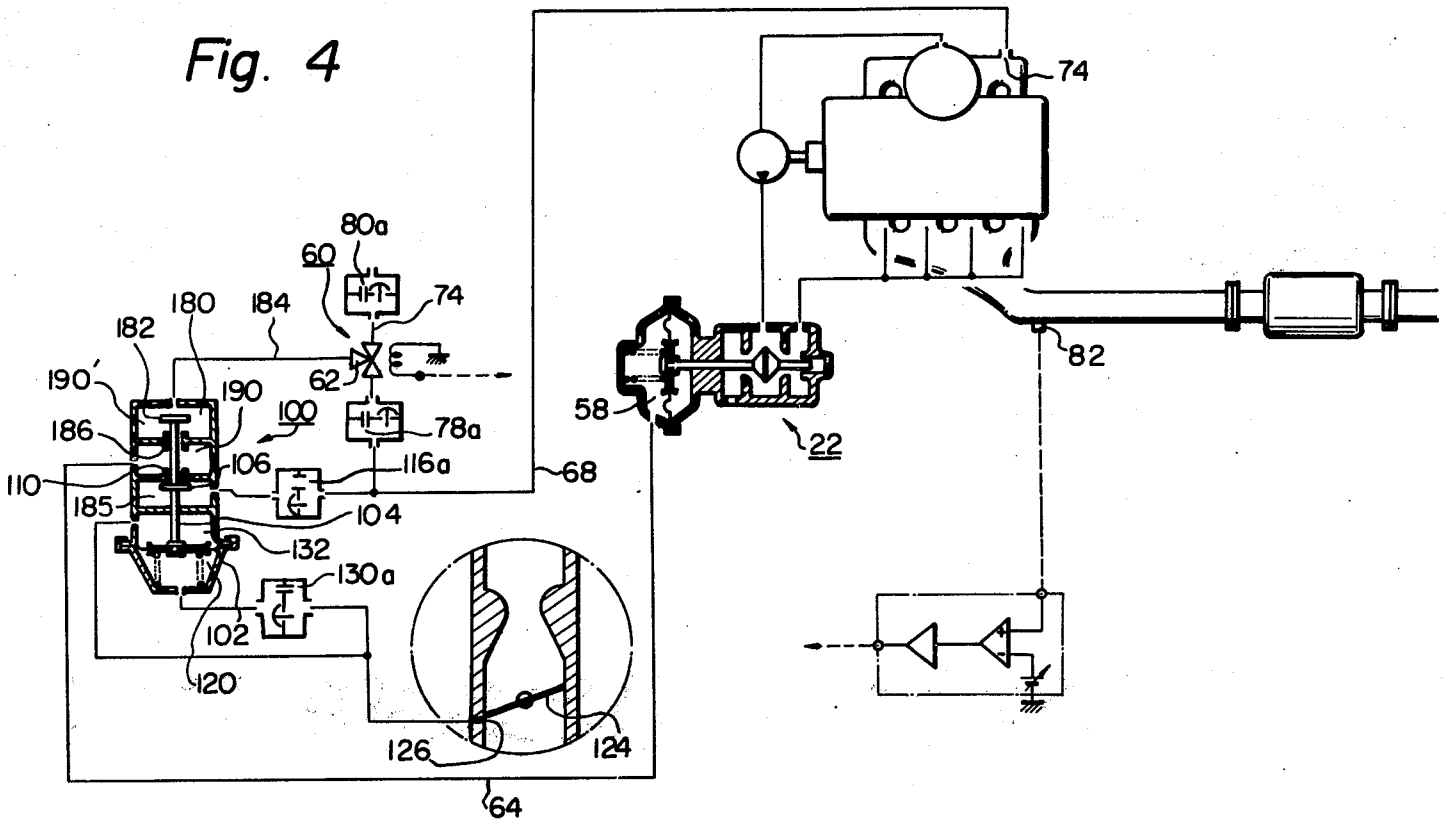

In the third embodiment shown in FIG. 4, the control valve 100 is slightly modified when compared with the embodiment of FIG. 1. In addition to having the valve member 106, situated in a chamber 185, the valve 100 further has another valve member 182 formed on the upper end of the rod 104. The other valve member 182 faces a valve seat 186 located between a chamber 190 connected the valve seat 110 and another chamber 190' connected to the common port 62 of the vacuum switching valve 60.

In the operation of the embodiment shown in FIG. 4, when the engine begins to accelerate, the control valve is moved downwardly so that the valve member 106 is detached from the valve seat 110, as described in the embodiment of FIG. 1. Thus the chamber 190 is connected to the chamber 185. In this case, the rate of introducing the vacuum signal into the vacuum signal chamber 58 of the flow control valve 22 is determined by the large orifice **116*a*. The downward movement of the valve member causes the other valve member 182 to be seated on the valve seat 186. Thus, the chamber 190 is disconnected from the chamber 190 when the engine is under the accelerating condition. The disconnection of the chamber 190' from the chamber 190 is advantageous, since a vacuum signal of a sufficient level transmitted from the port 74 to the chamber 58 can always be maintained, even if the vacuum switching valve 60 is accidentally shifted to its second position, by which position the common port 62 can communicate with the second port 72** which is opened to the atmosphere.

When the engine is under a constant rotational speed the diaphragm 102 is moved upwardly so that the valve member 106 is seated on the valve seat 110 and the valve member 182 is detached from the valve seat. Thus the chamber 190 is connected to the chamber 190' and also disconnected from the chamber 185. The connection of the chamber 190 with the chamber 190' causes the vacuum port 74 to be opened to the vacuum signal chamber 58 of the flow-control valve 22 via the conduit 68, the small orifice **78*a*, the ports 66 and 62, the conduit 184, the chamber 190, the valve seat 186, the chamber 190, and the conduit 64. The disconnection of the chamber 190 from the chamber 185 presents the vacuum signal from the large orifice 116*a* from being introduced into the vacuum signal chamber 58. In this case, the rate of increase in the amount of secondary air during the constant speed operation is determined by the orifice 78*a***.

What is claimed is:

1. An exhaust gas cleaning apparatus of an internal combustion engine, having an intake system, an engine body and an exhaust system, said apparatus comprising:
   - a catalytic converter disposed in said exhaust system, which converter effectively operates to clean the exhaust gas when the air-fuel ratio of an exhaust gas directed to the catalytic converter is maintained near a predetermined value;
   - pipe means connected to the exhaust system at a position located upstream of the catalytic converter for introducing secondary air into the exhaust system;
   - flow control valve means located on said pipe means having a pressure signal chamber for controlling the amount of secondary air directed to the exhaust system in response to the pressure level in said chamber;
   - sensor means arranged in said exhaust system for providing electric signals which indicate the air-fuel ratio of the exhaust gas;
   - pressure signal conduit means for connecting the pressure signal chamber of said flow-control valve with a pressure signal source;
   - pressure switching valve means responsive to said electric signals transmitted from said sensor means for selectively introducing a pressure signal from said source into said pressure signal chamber of said flow control valve means via said pressure signal conduit means in order to selectively increase the amount of secondary air directed into said exhaust system via said pipe means;

first orifice means disposed in said pressure signal conduit means at a position located upstream of said pressure switching valve means for controlling the rate of increase in the amount of secondary air; and pressure control means for maintaining, when the engine is operating under an acceleration condition, a rate of increase in the amount of secondary air high enough to effectively control the air-fuel ratio near to said predetermined value during the engine acceleration condition, said pressure control means comprising:

by-pass pressure signal conduit means adapted to communicate said pressure signal source with said pressure signal chamber of said flow control valve means;

pressure control mechanism for allowing the transmission of a pressure signal, via said by-pass conduit means, from said pressure signal source into said pressure signal chamber when the engine is under an acceleration condition; and second orifice means located on said by-pass conduit means, said second orifice means having an inner diameter larger than that of said first orifice means.

2. An exhaust gas cleaning apparatus according to claim 1, said pressure signal source is a vacuum port formed in said intake system of said engine for issuing a vacuum signal into said pressure signal conduit means connected to said vacuum port.

3. An exhaust gas cleaning apparatus according to claim 1, wherein said pressure control mechanism comprises:

a vacuum-operated valve located on said by-pass conduit means, adapted for operating to open and close said by-pass conduit means in response to a pressure difference between a first chamber and a second chamber, which are respectively formed on the each side of the diaphragm, said first chamber being directly connected to a vacuum port formed in said intake system at a position slightly above a throttle valve which is in its idle condition; and a vacuum delay valve for connecting said second chamber with said vacuum port, said delay valve including an orifice and a check valve.

4. An exhaust gas cleaning apparatus according to claim 3, wherein said pressure control mechanism further comprises an acceleration detecting valve for causing said vacuum-operated valve to open when said engine begins to accelerate.

5. An exhaust gas cleaning apparatus according to claim 3, wherein said vacuum-operated valve has a valve mechanism for preventing the vacuum switching valve from being connected to said vacuum signal chamber of said flow-control valve when said vacuum-operated valve is opened.

* * * * *